US010192529B2

(12) United States Patent
Huang

(10) Patent No.: US 10,192,529 B2
(45) Date of Patent: Jan. 29, 2019

(54) ELECTRONIC APPARATUS, FRAMES PER SECOND DECISION METHOD, AND NON-TRANSITORY COMPUTER READABLE STORAGE MEDIUM THEREOF

(71) Applicant: MEDIATEK INC., Hsin-Chu (TW)

(72) Inventor: Shih-Chieh Huang, New Taipei (TW)

(73) Assignee: MediaTek, Inc., Hsinchu (TW)

( * ) Notice: Subject to any disclaimer, the term of this patent is extended or adjusted under 35 U.S.C. 154(b) by 9 days.

(21) Appl. No.: 15/342,197

(22) Filed: Nov. 3, 2016

(65) Prior Publication Data

US 2017/0221457 A1 Aug. 3, 2017

Related U.S. Application Data

(60) Provisional application No. 62/290,496, filed on Feb. 3, 2016.

(51) Int. Cl.

| | |
|---|---|
| ***G09G 5/39*** | (2006.01) |
| ***G09G 5/395*** | (2006.01) |
| *G09G 5/393* | (2006.01) |

(52) U.S. Cl.

CPC ..... *G09G 5/395* (2013.01); *G09G 5/393* (2013.01); *G09G 2320/106* (2013.01); *G09G 2340/0435* (2013.01)

(58) Field of Classification Search

CPC ..... G09G 5/39; G09G 5/393; G09G 5/395; G09G 2320/106; G09G 2340/0435

USPC ..... 345/530, 545

See application file for complete search history.

(56) References Cited

U.S. PATENT DOCUMENTS

| | | | | |
|---|---|---|---|---|
| 8,249,070 | B2 * | 8/2012 | Song | H04N 21/23418 370/391 |
| 9,547,911 | B2 * | 1/2017 | Chen | G06T 7/20 |
| 9,621,841 | B1 * | 4/2017 | Hong | H04N 19/577 |
| 2002/0149693 | A1 * | 10/2002 | Tantalo | H04N 5/2351 348/362 |
| 2008/0100598 | A1 * | 5/2008 | Juenger | G09G 5/36 345/204 |
| 2011/0286635 | A1 * | 11/2011 | Nishigaki | G06T 7/248 382/107 |
| 2012/0308080 | A1 * | 12/2012 | Hamasaki | H04N 7/0127 382/103 |
| 2014/0160136 | A1 * | 6/2014 | Kaburlasos | G09G 5/00 345/520 |
| 2015/0348511 | A1 * | 12/2015 | Oriol | G06F 3/01 345/212 |
| 2017/0013192 | A1 * | 1/2017 | Yang | H04N 5/23232 |

* cited by examiner

*Primary Examiner* — Jacinta M Crawford

(74) *Attorney, Agent, or Firm* — Tong J. Lee

(57) ABSTRACT

An electronic apparatus, FPS decision method, and non-transitory computer readable storage medium thereof are provided. The electronic apparatus comprises a circuit. The circuit calculates a movement value according to a plurality of first data corresponding to a first frame for display and a plurality of second data corresponding to a second frame for display. The circuit further calculates a target FPS for displaying a plurality of third frames according to the movement value and a number of frame time between the first frame and the second frame.

15 Claims, 4 Drawing Sheets

ELECTRONIC APPARATUS, FRAMES PER SECOND DECISION METHOD, AND NON-TRANSITORY COMPUTER READABLE STORAGE MEDIUM THEREOF

This application claims the benefit of U.S. Provisional Application Ser. No. 62/290,496 filed on Feb. 3, 2016, which is hereby incorporated by reference in its entirety.

CROSS-REFERENCES TO RELATED APPLICATIONS

Not applicable.

BACKGROUND OF THE INVENTION

Field of the Invention

The present invention relates to an electronic apparatus, Frames Per Second (FPS) decision method, and non-transitory computer readable storage medium thereof. More particularly, the present invention relates to an electronic apparatus, FPS decision method, and non-transitory computer readable storage medium thereof that decide a target FPS for a software application based on movement information of the content of the software application.

Descriptions of the Related Art

Many software applications (e.g. videos, animations, and games) on the market today provide dynamic visualization, which is achieved by displaying a sequence of frames rapidly. Displaying frames of a software application by a greater Frames Per Second (FPS) results in smoother dynamic visualization (e.g. with less block effects and/or with less discontinuity), which, however, consumes more computing power and even more bandwidth. Therefore, there is a need in finding a target FPS for displaying frames of a software application, which compromises between the smoothness and the power consumption of the software application.

Some embodiments determine a target FPS for a software application based on user experiences. That is, before the release of a software application, having one or more users watch the display that shows the frames of the software application in different FPSs. The minimum FPS that satisfies most users in terms of smoothness is selected as the target FPS for the software application. Nevertheless, determining a target FPS for a software application based on user experiences is subjective because different users have different perceptions.

Some embodiments determine a target FPS for a software application based on the instant number of dropped frames. A target FPS determined in this way may not be suitable for all software applications because different software applications provide different types of dynamic contents. For example, the game named "Angry Birds" provides smooth dynamic visualization with 30 FPS. On the contrary, the game named "Garena" provides poor dynamic visualization with 48 FPS. As another example, the chat software application named "weixin" provides smooth dynamic visualization with 25 FPS, which is even lower than the FPS required by the game named "Angry Birds."

According to the above descriptions, how to decide a target FPS that compromises between the smoothness and power consumption of a software application is still in the need.

SUMMARY OF THE INVENTION

An objective of the present invention is to provide an electronic apparatus, which comprises a circuit. The circuit is configured to calculate a movement value according to a plurality of first data corresponding to a first frame for display and a plurality of second data corresponding to a second frame for display. The circuit is further configured to calculate a target Frames Per Second (FPS) for displaying a plurality of third frames according to the movement value and a number of frame time between the first frame and the second frame. The first frame, the second frame, and the third frames may belong to the same software application (e.g. a video, an animation, and a game).

Another objective of the present invention is to provide an FPS decision method for use in an electronic apparatus. The FPS decision method comprises the following steps of: (a) calculating, by the electronic apparatus, a movement value according to a plurality of first data corresponding to a first frame for display and a plurality of second data corresponding to a second frame for display and (b) calculating, by the electronic apparatus, a target FPS for displaying a plurality of third frames according to the movement value and a number of frame time between the first frame and the second frame. The first frame, the second frame, and the third frames may belong to the same software application (e.g. a video, an animation, and a game).

A further objective of the present invention is to provide a non-transitory computer readable storage medium, which has a computer program stored therein. The computer program executes an FPS decision method after being loaded into an electronic apparatus. The FPS decision method comprises the following steps of: (a) calculating, by the electronic apparatus, a movement value according to a plurality of first data corresponding to a first frame for display and a plurality of second data corresponding to a second frame for display and (b) calculating, by the electronic apparatus, a target FPS for displaying a plurality of third frames according to the movement value and a number of frame time between the first frame and the second frame. The first frame, the second frame, and the third frames may belong to the same software application (e.g. a video, an animation, and a game).

The present invention decides a target FPS for displaying a plurality of upcoming frames based on movement information of the content of recently displayed frames, wherein the upcoming frames and the recently displayed frames may belong to the same software application. Briefly speaking, the present invention calculates a movement value (e.g. a value representing a movement distance of one or more objects within the recently displayed frames) according to two recently displayed frames, and calculates a target FPS according to the movement value and a number of frame time between the two recently displayed frames. Then, the present invention may further display a plurality of upcoming frames based on the target FPS.

Since the target FPS is calculated based on the movement value and the number of frame time, it means that the movement velocities of one or more objects within the frames have been considered during the calculation of the target FPS. As neighboring frames tend to have similar contents (e.g. containing similar objects and having similar movement velocities), these upcoming frames can be displayed smoothly (e.g. with less block effects and/or with less discontinuity) based on the target FPS. By considering movement information of the content of the frames, the present invention is able to compromise between the smoothness and power consumption of the software application in the calculation of the target FPS.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

As addressed in the Section "Descriptions of the Related Art" of this specification, a target Frames Per Second (FPS) that is good for one software application (i.e. the frames of the software application can be displayed without block effects and without discontinuity) may not be good enough for another software application. Simply assigning a great FPS for a software application has the problem of consuming computation power severely. To compromise between the display smoothness and power consumption of a software application, the present invention decides a target FPS for a software application based on movement information of the content of the software application.

Figure 1:
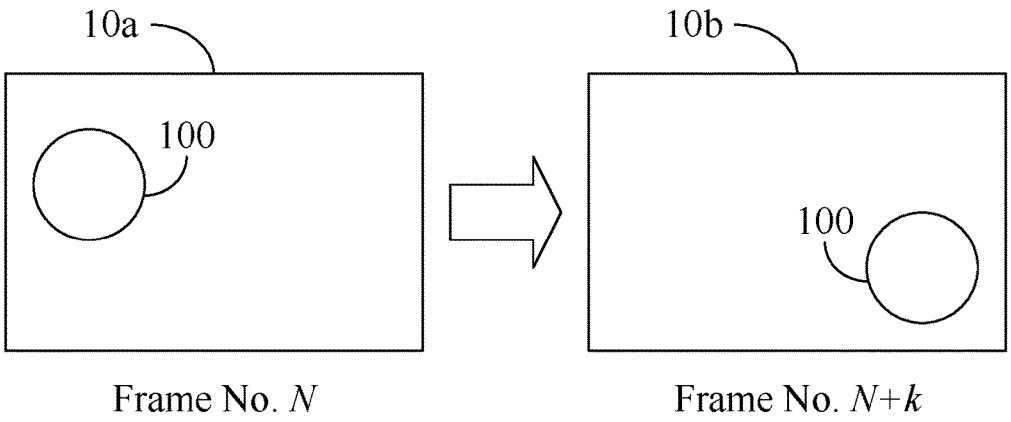
FIG. 1 illustrates the concept for deciding a target FPS for a software application according to the present invention.

FIG. 1 illustrates the concept for deciding a target FPS for a software application according to the present invention. The frames 10*a*, 10*b* are respectively the $N^{th}$ and $(N+k)^{th}$ frames of the software application, wherein the variable N is an integer and the variable k is a positive integer. Both the frames 10*a*, 10*b* contain an object 100. From the time instant that the frame 10*a* is displayed to the time instant that the frame 10*b* is displayed, the object 100 moves from the top-left corner to the bottom-right corner. The present invention decides the target FPS for displaying a plurality of upcoming frames (e.g. the frames coming right after the frame 10*b*) of the software application based on the movement information of the content of two recently displayed frames of the software application (e.g. the moving velocity of the object 100 of the frames 10*a*, 10*b*). In this way, the present invention is able to decide a greater target FPS for a software application that contains fast-moving content and decide a smaller target FPS for a software application that contains slow-moving content. For a software application that contains fast-moving content in some instants and slow-moving content in other instants, the present invention is able to dynamically change the target FPS.

In the following descriptions, electronic apparatus, FPS decision method, and non-transitory computer readable storage medium thereof of the present invention will be explained with reference to embodiments thereof. However, these embodiments are not intended to limit the present invention to any specific environment, software applications, or particular implementations described in these embodiments. Therefore, descriptions of these embodiments are only for purpose of illustration rather than to limit the present invention. It should be appreciated that elements unrelated to the present invention are omitted from depiction in the following embodiments and the attached drawings.

Figure 2A:
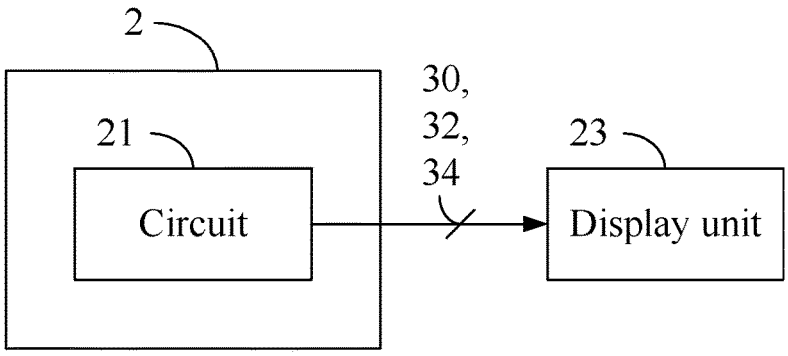
FIG. 2A illustrates the electronic apparatus 1 of the first embodiment of the present invention.

FIG. 2A illustrates a schematic view of an electronic apparatus 2 of a first embodiment according to the present invention. The electronic apparatus 2 comprises a circuit 21, which is electrically connected to an external display unit 23. The display unit 23 may be any display unit, module, or device well known by persons having ordinary skill in the art.

Figure 2B:
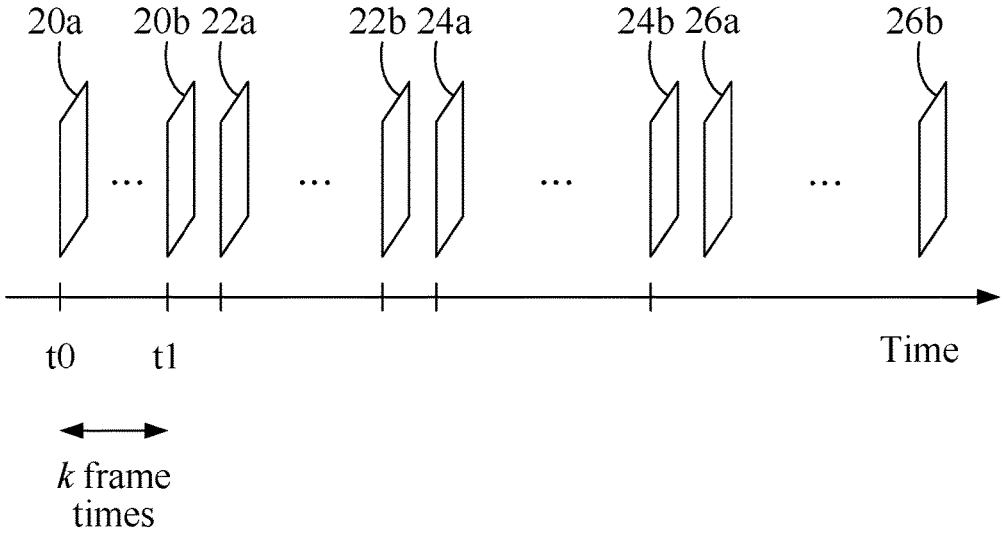
FIG. 2B illustrates a plurality of frames of a software application in the first embodiment.

The circuit 21 executes a software application (not shown). As shown in FIG. 2B, the software application comprises a plurality of frames 20*a*, . . . , 20*b*, 22*a*, . . . 22*b*, 24*a*, . . . 24*b*, 26*a*, . . . 26*b* for display. In FIG. 2B, the horizontal axis represents the elapse of time. Each of the frames 20*a*, . . . , 20*b*, 22*a*, . . . 22*b*, 24*a*, . . . 24*b*, 26*a*, . . . 26*b* comprises a plurality of pixels and each of the pixels has a pixel value. The time elapsed between two consecutive frames is called "frame time." Taking FIG. 1 as an example, there are k frame times between the $N^{th}$ frame and the $(N+k)^{th}$ frame.

In this embodiment, from time to time, the circuit 21 calculates a target FPS for the software application and the display unit 23 displays the upcoming frames of the software application according to the latest calculated target FPS. In other words, the display unit 23 displays the frames 20*a*, . . . , 20*b*, 22*a*, . . . 22*b*, 24*a*, . . . 24*b*, 26*a*, . . . 26*b* according to the dynamic adjusted target FPS. The details of the operations performed by the circuit 21 and the display unit 23 are given below.

At first, the display unit 23 displays the frames 20*a*, . . . , 20*b* in sequence based on a default FPS (e.g. 30 FPS). Then, the circuit 21 calculates a first movement value (not shown) according to a plurality of data corresponding to the frame 20*a* and a plurality of data corresponding to the frame 20*b*. In this embodiment, the data corresponding to the frame 20*a* are the pixel values of the frame 20*a* and the data corresponding to the frame 20*b* are the pixel values of the frame 20*b*. In some other embodiments, the data corresponding to the frame 20*a* may be a plurality of pixel values of a scaled-down version of the frame 20*a* and the data corresponding to the frame 20*b* may be a plurality of pixel values of a scaled-down version of the frame 20*b*.

The first movement value may be considered as a value representing a movement distance of one or more objects within the frames 20*a*, 20*b*. The present invention provides several approaches for calculating the first movement value, which are elaborated in the following paragraphs.

In some embodiments, the circuit 21 may adopt the technique of Feature Extraction and Feature Matching (FEFM) for calculating the first movement value. In a first example of FEFM, the circuit 21 calculates a plurality of motion vectors according to the plurality of data corresponding to the frame 20*a* and the plurality of data corresponding to the frame 20*b*, and selects one of the motion vectors as first movement value. In a second example of FEFM, the circuit 21 determines a plurality of feature points (not shown) corresponding to the frame 20*a*, determines a plurality of feature points (not shown) corresponding to the frame 20*b*, calculates a plurality of motion vectors (not shown) according to the feature points corresponding to the frame 20*a* and the feature points corresponding to the frame 20*b*, and decides the first movement value according to the motion vectors. It is noted that the decided first movement value may be one of the motion vectors (e.g. the maximum motion vectors) or a statistical value of the motion vectors (e.g. an average of the motion vectors). It is also noted that a person having ordinary skill in the art should be able to appreciate that a feature point of a frame is a point that can be differentiated from its neighboring points.

Yet in some embodiments, the circuit 21 may adopt the technique of finding an optic flow for calculating the first movement value. A person having ordinary skill in the art should be able to appreciate that an optical flow is the pattern of apparent motion of objects, surfaces, and edges in the frames. To be more specific, the circuit 21 calculates a plurality of optical flows according to the data corresponding to the frame 20*a* and the data corresponding to the frame 20*b*, and selects one of the optical flows (e.g. the maximum optical flow) as the first movement value. It is noted that some other embodiments may use a statistical value of the optical flows (e.g. an average of the optical flows) as the first movement value. It is also noted that the present invention may adopt other technique for calculating the first movement value as long as that technique is able to derive a value representing a movement distance of one or most objects within the frames 20*a*, 20*b*.

After the calculation of the first movement value, the circuit 21 calculates a target FPS 30 according to the first movement value and the number of frame times between the frame 20*a* and the frame 20*b*. To be more specific, the circuit 21 may calculate the target FPS 30 by dividing the first movement value by the number of frame times between the frame 20*a* and the frame 20*b*. The circuit 21 may derive the number of frame times between the frame 20*a* and the frame 20*b* by several approaches alternatively. In some embodiments, the number of frame times between the frame 20*a* and the frame 20*b* may be calculated by subtracting the index number of the frame 20*a* from the index number of the frame 20*b*. For example, if the frames 20*a*, 20*b* are respectively the $N^{th}$ and $(N+k)^{th}$ frames of the software application, the number of frame times between the frame 20*a* and the frame 20*b* is k. In some embodiments, the circuit 21 may derive the number of frame times between the frame 20*a* and the frame 20*b* by calculating the time difference between the frames 20*a*, 20*b* (i.e. subtracting the time instant t0 that the frame 20*a* is displayed from the time instant t1 that the frame 20*b* is displayed) and then dividing the time difference between the frames 20*a*, 20*b* by the length of one frame time.

After the circuit 21 have calculated the target FPS 30, the target FPS used by the display unit 23 is adjusted from the default FPS to the target FPS 30. Then, the display unit 23 displays the frames 22*a*, . . . , 22*b* that comes after the frame 20*a* and the frame 20*b* based on the target FPS 30. The idea of using the target FPS 30 calculated based on the frames 20*a*, 20*b* to display the frames 22*a*, . . . , 22*b* is that neighboring frames tend to have similar contents (e.g. containing similar objects and having similar movement velocities). For example, when the frames 20*a*, 20*b* contain fast-moving content, it is highly possible that the frames 22*a*, . . . , 22*b* contain fast-moving content. As another example, when the frames 20*a*, 20*b* contain slow-moving content, it is highly possible that the frames 22*a*, . . . , 22*b* contain slow-moving content. By adopting the target FPS 30, the display unit 23 can display the frames 22*a*, . . . , 22*b* smoothly (e.g. with less block effects and/or with less discontinuity).

The content of the software application varies from time to time, which means that the software application may change from having slow-moving content to having fast-moving content or vice versa. To adapt to the change, the circuit 21 continues to calculate another target FPS for the upcoming frames in this embodiment. That is, the circuit 21 calculates a target FPS 32 for the frames 24*a*, . . . , 24*b* that comes after the frames 22*a*, . . . , 22*b* based on any two of the frames 22*a*, . . . , 22*b*. For convenience, it is assumed that the frames 22*a*, 22*b* are utilized for calculating the target FPS 32. The details that the circuit 21 calculates the target FPS 32 based on the frames 22*a*, 22*b* are similar to the details that the circuit 21 calculates the target FPS 30 based on the frames 20*a*, 20*b*.

Briefly speaking, the circuit 21 calculates a second movement value (not shown) according to a plurality of data corresponding to the frame 22*a* and a plurality of data corresponding to the frame 22*b*. In this embodiment, the data corresponding to the frame 22*a* are the pixel values of the frame 22*a* and the data corresponding to the frame 22*b* are the pixel values of the frame 20*b*. In some other embodiments, the data corresponding to the frame 22*a* may be a plurality of pixel values of a scaled-down version of the frame 22*a* and the data corresponding to the frame 22*b* may be a plurality of pixel values of a scaled-down version of the frame 22*b*. Similarly, the second movement value may be considered as a value representing a movement distance of one or more objects within the frames 22*a*, 22*b*. In some embodiments, the circuit 21 may adopt the technique of FEFM for calculating the second movement value. Yet in some other embodiments, the circuit 21 may adopt the technique of optic flow for calculating the second movement value.

After the calculation of the second movement value, the circuit 21 calculates the target FPS 32 according to the second movement value and the number of frame times between the frame 22*a* and the frame 22*b*. To be more specific, the circuit 21 may calculate the target FPS 32 by dividing the second movement value by the number of frame times between the frame 22*a* and the frame 22*b*. Please note that the number of frame times between the frame 22*a* and the frame 22*b* and the number of frame times between the frame 20*a* and the frame 20*b* may be different. In addition, the target FPS 32 and the target FPS 30 may be different.

After the circuit 21 have calculated the target FPS 32, the target FPS used by the display unit 23 is adjusted from the target FPS 30 to the target FPS 32. Then, the display unit 23 displays the frames 24*a*, . . . , 24*b* that comes after the frame 22*a*, 22*b* based on the target FPS 32. Likewise, the idea of using the target FPS 32 calculated based on the frames 22*a*, 22*b* to display the frames 24*a*, . . . , 24*b* is that neighboring frames tend to have similar contents (e.g. containing similar objects and having similar movement velocities). Hence, the display unit 23 can display the frames 22*a*, . . . , 22*b* smoothly (e.g. with less block effects and/or with less discontinuity) by adopting the target FPS 30.

In this embodiment, the circuit 21 continues to calculate a target FPS 34 for the frames 26*a*, . . . , 26*b* that comes after the frames 24*a*, . . . , 24*b* based on any two of the frames 24*a*, . . . , 24*b* and so on and so forth. Nevertheless, please note that the present invention does not limit the number of times that the circuit 21 calculates the target FPS. For example, if the movement velocities of the objects within the frames of a software application are steady (e.g. the chat software application named "weixin"), the circuit 21 may calculate the target FPS for the software application only once to reduce the power consumption.

According to the above descriptions, electronic apparatus 2 decides a target FPS for a software application based on movement information of two recently displayed frames and then displays a plurality of upcoming frames based on the latest target FPS. As neighboring frames tend to have similar contents, the upcoming frames can be displayed smoothly. By considering movement information of the content of the software application, the present invention is able to compromise between the smoothness and power consumption of the software application in the calculation of the target FPS.

Figure 3A:
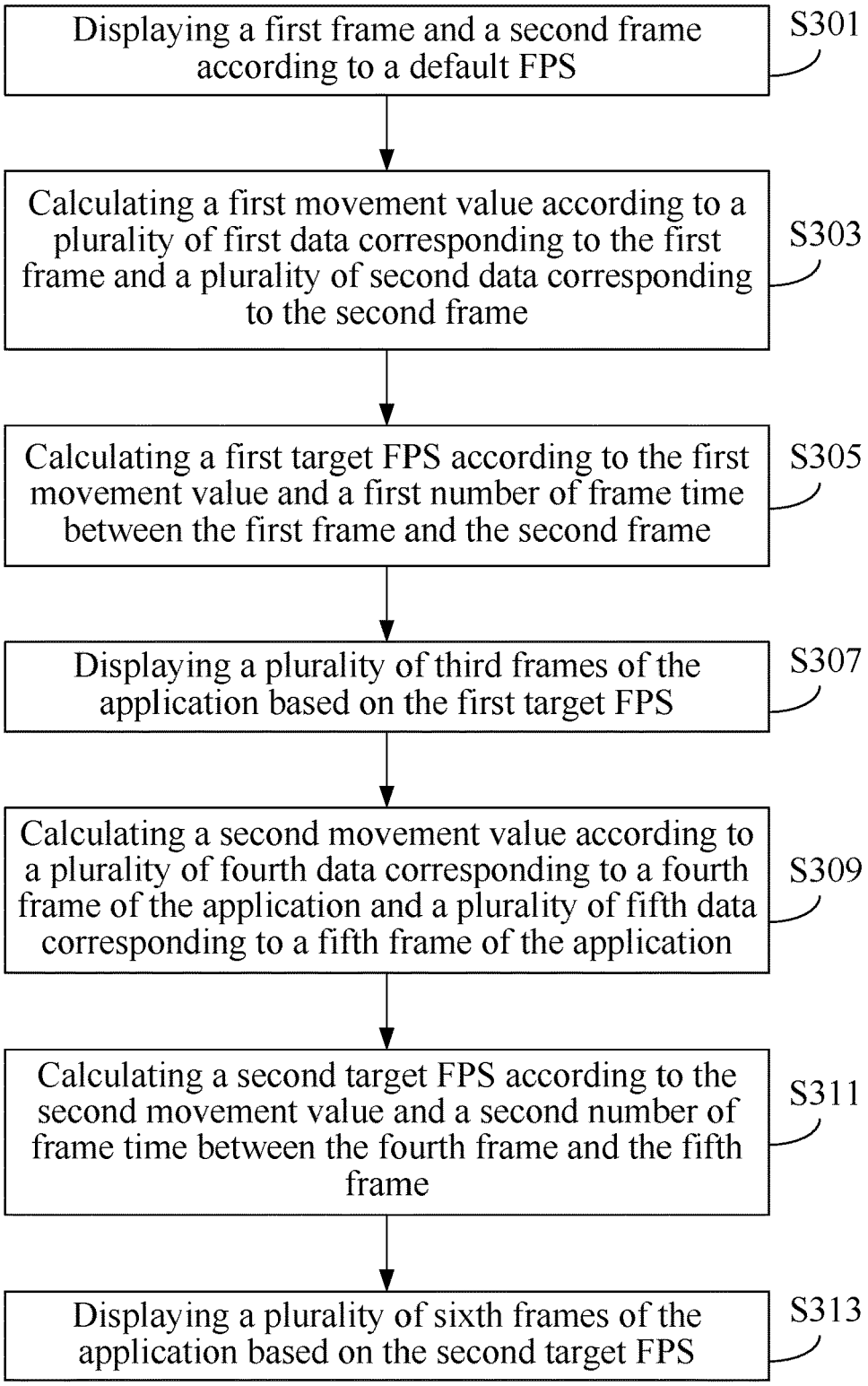
FIG. 3A illustrates the flowchart of the FPS decision method of the second embodiment.

A second embodiment of the present invention is an FPS decision method for use in an electronic apparatus (e.g. the electronic apparatus 2 in the first embodiment) and whose flowchart is illustrated in FIG. 3A.

First, step S301 is executed by the electronic apparatus for displaying a first frame and a second frame of a software application according to a default FPS. In some other embodiments, the step S301 may be omitted when an electronic apparatus does not have a display unit.

Next, step S303 is executed by the electronic apparatus for calculating a first movement value according to a plurality of first data corresponding to the first frame for display and a plurality of second data corresponding to the second frame for display. In this embodiment, the first data corresponding to the first frame are a plurality of pixel values of the first frame and the second data corresponding to the second frame are a plurality of pixel values of the second frame. In some other embodiments, the first data corresponding to the first frame may be a plurality of pixel values of a scaled-down version of the first frame and the second data corresponding to the second frame may be a plurality of pixel values of a scaled-down version of the second frame.

Figure 3B:
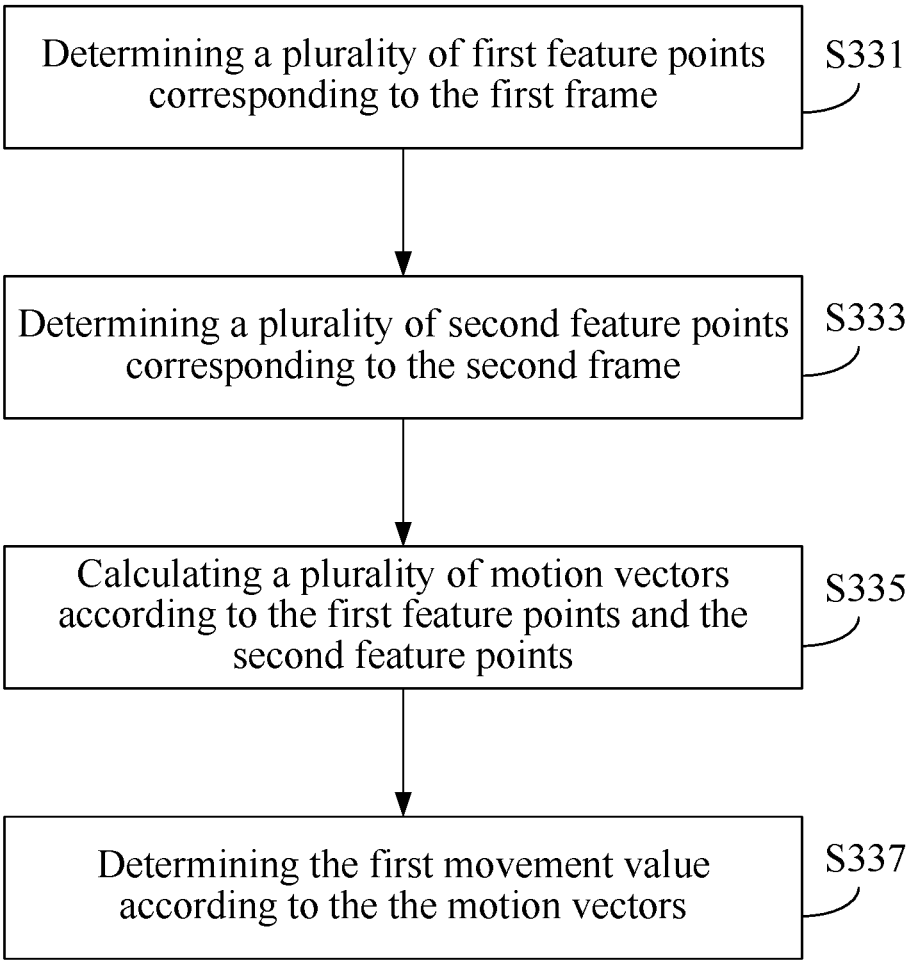
FIG. 3B illustrates the flowchart of FEFM.

It is noted that the first movement value may be considered as a value representing a movement distance of one or more objects within the first frame and second frame. In some embodiments, the step S303 may be achieved by the technique of FEFM. In a first example of FEFM, the step S303 may be achieved by a step of calculating a plurality of motion vectors according to the first data and the second data and a step of selecting one of the motion vectors as the first movement value. In a second example of FEFM, the step S303 may be achieved by the steps shown in FIG. 3B. In step S331, the electronic apparatus determines a plurality of first feature points corresponding to the first frame. Next, step S333 is executed by the electronic apparatus for determining a plurality of second feature points corresponding to the second frame. Next, step S335 is executed by the electronic apparatus for calculating a plurality of motion vectors according to the first feature points and the second feature points. Following that, step S337 is executed by the electronic apparatus for determining the first movement value according to the motion vectors. For example, the first movement value may be one of the motion vectors (e.g. the maximum motion vectors) or a statistical value of the motion vectors (e.g. an average of the motion vectors).

In some embodiments, the step S303 may be achieved by the technique of optical flow. For those embodiments, a step (not shown) is executed by the electronic apparatus for calculating a plurality of optical flows according to the first data and the second data and another step is executed by the electronic apparatus for selecting one of the optical flows (e.g. the maximum optical flow) as the first movement value. Yet in some other embodiments, a statistical value of the optical flows (e.g. an average of the optical flows) may be calculated as the first movement value.

After the execution of the step S303, step S305 is executed by the electronic apparatus for calculating a first target FPS according to the first movement value and a first number of frame time between the first frame and the second frame. It is noted that the time elapsed between two consecutive frames is called "frame time." In some embodiments, the step S305 may calculate the first target FPS by dividing the first movement value by the first number of frame time.

Next, step S307 is executed by the electronic apparatus for displaying a plurality of third frames of the software application based on the first target FPS, wherein each of the third frames comes after the first frame and the second frame. In some other embodiments, the step S307 may be omitted when an electronic apparatus does not have a display unit.

In some embodiments, the FPS decision method may further comprises steps S309, S311, and S313. In step S309, the electronic apparatus calculates a second movement value according to a plurality of fourth data corresponding to a fourth frame of the software application for display and a plurality of fifth data corresponding to a fifth frame of the software application for display. Each of the fourth frame and fifth frame may be one of the third frames displayed in the step S307. In this embodiment, the fourth data corresponding to the fourth frame are a plurality of pixel values of the fourth frame and the fifth data corresponding to the fifth frame are a plurality of pixel values of the fifth frame. In some other embodiments, the fourth data corresponding to the fourth frame may be a plurality of pixel values of a scaled-down version of the fourth frame and the fifth data corresponding to the fifth frame may be a plurality of pixel values of a scaled-down version of the fifth frame.

Next, step S311 is executed by the electronic apparatus for calculating a second target FPS according to the second movement value and a second number of frame time between the fourth frame and the fifth frame. In some embodiments, the step S311 may be achieved by the technique of FEFM. In some other embodiments, the step S311 may be achieved by the technique of optical flow. Afterwards, step S313 is executed by the electronic apparatus for displaying a plurality of sixth frames of the software application based on the second target FPS. In some other embodiments, the step S313 may be omitted when an electronic apparatus does not have a display unit.

In some embodiments, the FPS decision method may repeat the steps S303 and S305 (or the steps S309 and S311) based on any two recently displayed frames in order to derive the latest target FPS. The details are not repeated.

In addition to the aforesaid steps, the second embodiment can also execute all the operations and have all the functionalities of the electronic apparatus set forth in the first embodiment. The second embodiment executing these operations and having these functionalities will be readily appreciated by those of ordinary skill in the art based on the explanation of the first embodiment. Thus, the details will not be further described herein.

The FPS decision method described in the second embodiment may be implemented by a computer program having a plurality of codes. The computer program can be stored in a tangible non-transitory computer readable storage medium. When the codes are loaded into an electronic apparatus (e.g. the electronic apparatus 2 in the first embodiment), the computer program executes the FPS decision method as described in the second embodiment. The tangible non-transitory computer readable storage medium may be an electronic product, such as a read only memory (ROM), a flash memory, a floppy disk, a hard disk, a compact disk (CD), a mobile disk, a magnetic tape, a database accessible to networks, or any other storage media with the same function and well known to those skilled in the art.

It shall be appreciated that in the specification and the claims of the present application, the words "first," "second," "third," "fourth," "fifth," and "six" in the terms "first frame," "second frame," "third frame," "fourth frame," "fifth frame," and "sixth frame" are used for the purpose of distinguishing different frames. Similarly, the words "first," "second," "fourth," and "fifth" in the terms "first data,"

"second data," "fourth data," and "fifth data" are used for the purpose of distinguishing different data. Likewise, the words "first" and "second" in the terms "first movement" and "second movement" are used for the purpose of distinguishing different movements. The words "first" and "second" in the terms "first target FPS" and "second target FPS" are used for the purpose of distinguishing different target FPSs. The words "first" and "second" in the terms "first number of frame time" and "second number of frame time" are used for the purpose of distinguishing different numbers of frame time. The words "first" and "second" in the terms "first feature points" and "second feature points" are used for the purpose of distinguishing different feature points.

According to the above descriptions, the present invention decides a target FPS for a software application based on movement information of the content of the software application. The present invention calculates a movement value according to two recently displayed frames of the software application and calculates a target FPS according to the movement value and a number of frame time between the two recently displayed frames. Then, the present invention displays a plurality of upcoming frames based on the target FPS. The procedure for calculating a target FPS may be repeated.

Since the target FPS is calculated based on the movement value and the number of frame time, it means that the movement velocities of one or more objects within the frames have been considered during the calculation of the target FPS. As neighboring frames tend to have similar contents, these upcoming frames can be displayed smoothly. By considering movement information of the content of the software application, the present invention is able to compromise between the smoothness and power consumption of the software application in the calculation of the target FPS.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. An electronic apparatus, comprising:

a circuit, being configured to calculate a first movement value according to a plurality of first data corresponding to a first frame for display and a plurality of second data corresponding to a second frame for display, and calculate a first target Frames Per Second (FPS) for displaying a plurality of third frames according to the first movement value and a first number of frame time between the first frame and the second frame, wherein the first movement value indicates a movement distance of one or more objects between the first frame and the second frame, and the first number of frame time indicates a time measurement between the first frame and the second frame, and wherein the circuit calculates the first target FPS by dividing the first movement value by the first number of frame time, and wherein the greater the first target FPS, the faster the plurality of third frames are displayed.

2. The electronic apparatus of claim 1, wherein the circuit further calculates a second movement value according to a plurality of fourth data corresponding to a fourth frame for display and a plurality of fifth data corresponding to a fifth frame for display, the circuit further calculates a second target FPS for displaying a plurality of sixth frames according to the second movement value and a second number of frame time between the fourth frame and the fifth frame, and the first target FPS and the second target FPS are different.

3. The electronic apparatus of claim 1, wherein the circuit calculates a plurality of motion vectors according to the first data and the second data, and selects one of the motion vectors as the first movement value.

4. The electronic apparatus of claim 1, wherein the circuit calculates a plurality of optical flows according to the first data and the second data, and selects one of the optical flows as the first movement value.

5. The electronic apparatus of claim 1, wherein the first data are a plurality of first pixel values of a scaled-down version of the first frame and the second data are a plurality of second pixel values of a scaled-down version of the second frame.

6. A Frames Per Second (FPS) decision method for use in an electronic apparatus, comprising the following steps of:

(a) calculating, by the electronic apparatus, a first movement value according to a plurality of first data corresponding to a first frame for display and a plurality of second data corresponding to a second frame for display;

(b) calculating, by the electronic apparatus, a first target FPS for displaying a plurality of third frames according to the first movement value and a first number of frame time between the first frame and the second frame, wherein the first movement value indicates a movement distance of one or more objects between the first frame and the second frame, and the first number of frame time indicates a time measurement between the first frame and the second frame; and c) calculating, by the electronic apparatus, the first target FPS by dividing the first movement value by the first number of frame time, and wherein the greater the first target FPS, the faster the plurality of third frames are displayed.

7. The FPS decision method of claim 6, further comprising the following steps of:

calculating, by the electronic apparatus, a second movement value according to a plurality of fourth data corresponding to a fourth frame for display and a plurality of fifth data corresponding to a fifth frame for display; and calculating, by the electronic apparatus, a second target FPS for displaying a plurality of sixth frames according to the second movement value and a second number of frame time between the fourth frame and the fifth frame, wherein the first target FPS and the second target FPS are different.

8. The FPS decision method of claim 6, further comprising the steps of:

calculating a plurality of motion vectors according to the first data and the second data by the electronic apparatus; and selecting one of the motion vectors as the first movement value by the electronic apparatus.

9. The FPS decision method of claim 6, further comprising the steps of:

calculating a plurality of optical flows according to the first data and the second data by the electronic apparatus; and selecting one of the optical flows as the first movement value by the electronic apparatus.

10. The FPS decision method of claim 6, wherein the first data are a plurality of first pixel values of a scaled-down version of the first frame and the second data are a plurality of second pixel values of a scaled-down version of the second frame.

11. A non-transitory computer readable storage medium, having a computer program stored therein, the computer program executing a Frames Per Second (FPS) decision method after being loaded into an electronic apparatus, the FPS decision method comprising the following steps of:

(a) calculating, by the electronic apparatus, a first movement value according to a plurality of first data corresponding to a first frame for display and a plurality of second data corresponding to a second frame for display;

(b) calculating, by the electronic apparatus, a first target FPS for displaying a plurality of third frames according to the first movement value and a first number of frame time between the first frame and the second frame, wherein the first movement value indicates a movement distance of one or more objects between the first frame and the second frame, and the first number of frame time indicates a time measurement between the first frame and the second frame; and c) calculating, by the electronic apparatus, the first target FPS by dividing the first movement value by the first number of frame time, and wherein the greater the first target FPS, the faster the plurality of third frames are displayed.

12. The non-transitory computer readable storage medium of claim 11, wherein the FPS decision method further comprises the following steps of:

calculating, by the electronic apparatus, a second movement value according to a plurality of fourth data corresponding to a fourth frame for display and a plurality of fifth data corresponding to a fifth frame for display; and calculating, by the electronic apparatus, a second target FPS for displaying a plurality of sixth frames according to the second movement value and a second number of frame time between the fourth frame and the fifth frame, wherein the first target FPS and the second target FPS are different.

13. The non-transitory computer readable storage medium of claim 11, wherein the FPS decision method further comprises the following steps of:

calculating a plurality of motion vectors according to the first data and the second data by the electronic apparatus; and selecting one of the motion vectors as the first movement value.

14. The non-transitory computer readable storage medium of claim 11, wherein the FPS decision method further comprises the following steps of:

calculating a plurality of optical flows according to the first data and the second data by the electronic apparatus; and selecting one of the optical flows as the first movement value.

15. The non-transitory computer readable storage medium of claim 11, wherein the first data are a plurality of first pixel values of a scaled-down version of the first frame and the second data are a plurality of second pixel values of a scaled-down version of the second frame.

* * * * *